US006739930B2

(12) United States Patent
Cheng et al.

(10) Patent No.: US 6,739,930 B2
(45) Date of Patent: May 25, 2004

(54) PROCESS FOR FORMING FIELD EMISSION ELECTRODE FOR MANUFACTURING FIELD EMISSION ARRAY

(75) Inventors: Huang-Chung Cheng, Hsinchu (TW); Fu-Gom Tarntair, Hsinchu (TW); Chia-Pin Lin, Hsinchu (TW)

(73) Assignee: National Science Council, Taipei (TW)

( * ) Notice: Subject to any disclaimer, the term of this patent is extended or adjusted under 35 U.S.C. 154(b) by 6 days.

(21) Appl. No.: 09/925,356

(22) Filed: Aug. 9, 2001

(65) Prior Publication Data

US 2002/0102899 A1 Aug. 1, 2002

(30) Foreign Application Priority Data

Oct. 24, 2000 (TW) ..... 89122379 A

(51) Int. Cl.[7] ..... H01J 9/00
(52) U.S. Cl. ..... 445/24
(58) Field of Search ..... 445/24, 49–51; 313/309, 210, 211

(56) References Cited

U.S. PATENT DOCUMENTS 4,008,412 A * 2/1977 Yuito et al. ..... 313/309
4,095,133 A * 6/1978 Hoeberechts ..... 313/336
5,401,676 A * 3/1995 Lee ..... 438/20
5,449,435 A * 9/1995 Ageno et al. ..... 216/11
5,481,156 A * 1/1996 Lee et al. ..... 313/309
5,643,032 A * 7/1997 Cheng et al. ..... 445/24
5,666,020 A * 9/1997 Takemura ..... 313/306
5,739,628 A * 4/1998 Takada ..... 313/309
5,779,514 A * 7/1998 Cheng et al. ..... 445/24
5,818,153 A * 10/1998 Allen ..... 313/306
5,834,790 A * 11/1998 Suzuki ..... 257/10
5,982,081 A * 11/1999 Sin et al. ..... 313/309
6,017,257 A * 1/2000 Potter ..... 445/24
6,049,089 A * 4/2000 Cathey ..... 257/10
6,080,032 A * 6/2000 Alwan ..... 445/50
6,165,808 A * 12/2000 Zhang ..... 438/20
6,232,705 B1 * 5/2001 Forbes et al. ..... 313/309
6,326,221 B1 * 12/2001 Lee et al. ..... 438/20
6,387,717 B1 * 5/2002 Blalock et al. ..... 438/20
6,461,526 B1 * 10/2002 Wilson ..... 216/11
6,498,425 B1 * 12/2002 Derraa ..... 313/309
6,617,772 B1 * 9/2003 Barton et al. ..... 445/24

* cited by examiner

*Primary Examiner*—Dean A. Reichard
*Assistant Examiner*—Adolfo Nino
(74) *Attorney, Agent, or Firm*—Volpe and Koenig, P.C.

(57) ABSTRACT

A process of forming a field emission electrode for manufacturing a field emission array is provided. The process includes steps of (a) providing a substrate having a metal layer thereon, (b) forming a plurality of mask units on the metal layer and partially removing the metal layer uncovered by the mask units, (c) oxidizing a surface of the remained metal layer by an anodic oxidization method for forming a metal oxide layer thereon such that an upper portion of the unoxidized remained metal layer is in the shape of plural conoids, and (d) removing the remained mask units and the metal oxide layer. Alternatively, the process includes steps of (a) providing a substrate having a first metal layer thereon, (b) forming a plurality of mask units on the first metal layer and partially removing the first metal layer uncovered by the mask units, (c) oxidizing a surface of the remained first metal layer by an anodic oxidization method for forming a metal oxide layer thereon such that an upper portion of the unoxidized remained first metal layer is in the shape of plural cylinders, (d) forming a second metal layer on the metal oxide layer, and (e) removing the remained mask units.

17 Claims, 6 Drawing Sheets

PROCESS FOR FORMING FIELD EMISSION ELECTRODE FOR MANUFACTURING FIELD EMISSION ARRAY

FIELD OF THE INVENTION

The present invention is related to a process of forming a field emission electrode, and more particularly to a process of forming a field emission electrode for manufacturing a field emission array.

BACKGROUND OF THE INVENTION

It's a critical step to form a field emission electrode for manufacturing a field emission array (FEA), because the field emission electrode is used to provide stable electron beam to excite the fluorescent substances for forming an image. Certainly, the color, the brightness, the contrast and the life span of a field emission display (FED) is related to the quality of the field emission electrode.

According to the prior arts, the field emission electrode is formed by an obliquity sputtering technique. The field emission electrode with the structure of plural conoids in shape thereon is formed by the semiconductor processing technique and a high temperature oxidization technique. Certainly, the field emission electrode can be formed by further forming a metal film or a diamond film thereon for improving the quality of the field emission electrode. However, according to the prior arts, it's not easy to form a field emission electrode with large area and good thickness uniformity at room temperature.

Accordingly, it is attempted by the present applicant to solve the above-described problems encountered in the prior arts.

SUMMARY OF THE INVENTION

According to one aspect of the present invention, a process of forming a field emission electrode for manufacturing a field emission array is provided. The process includes steps of (a) providing a substrate having a metal layer thereon, (b) forming a plurality of mask units on the metal layer and partially removing the metal layer uncovered by the mask units, (c) oxidizing a surface of the remained metal layer by an anodic oxidization method for forming a metal oxide layer thereon such that an upper portion of the unoxidized remained metal layer is in the shape of plural conoids, and (d) removing the remained mask units and the metal oxide layer.

Preferably, the substrate is made of a material selected from a group consisting of plastic, quartz and glass.

Preferably, the metal layer is selected from a group consisting of aluminum layer, tungsten layer, tantalum layer, molybdenum layer, molybdenum-tungsten alloy layer and molybdenum-tantalum alloy layer.

Preferably, the metal layer is formed on the substrate by a method selected from a group consisting of electron gun evaporation, sputtering technique and heat coating technique.

Preferably, the step (b) is performed by a photolithography technique and an etching method.

Preferably, the etching method is selected from reactive ion etching method and wet etching method.

According to another aspect of the present invention, a process of forming a field emission electrode for manufacturing a field emission array is provided. The process includes steps of (a) providing a substrate having a first metal layer thereon, (b) forming a plurality of mask units on the first metal layer and partially removing the first metal layer uncovered by the mask units, (c) oxidizing a surface of the remained first metal layer by an anodic oxidization method for forming a metal oxide layer thereon such that an upper portion of the unoxidized remained first metal layer is in the shape of plural cylinders, (d) forming a second metal layer on the metal oxide layer, and (e) removing the remained mask units.

Preferably, the substrate is made of a material selected from a group consisting of plastic, quartz and glass.

Preferably, the first metal layer and the second metal layer are selected from a group consisting of aluminum layer, tungsten layer, tantalum layer, molybdenum layer, molybdenum-tungsten alloy layer and molybdenum-tantalum alloy layer.

Preferably, the first metal layer is formed on the substrate by a method selected from a group consisting of electron gun evaporation, sputtering technique and heat coating technique.

Preferably, the second metal layer is formed on the metal oxide layer by a method selected from a group consisting of electron gun evaporation, sputtering technique and heat coating technique.

Preferably, the step (b) is performed by a photolithography technique and an etching method.

Preferably, the etching method is selected from reactive ion etching method and wet etching method.

BRIEF DESCRIPTION OF THE DRAWING

The present invention may best be understood through the following description with reference to the accompanying drawings, in which.

DETAILED DESCRIPTION OF THE PREFERRED EMBODIMENTS

Figure 1:
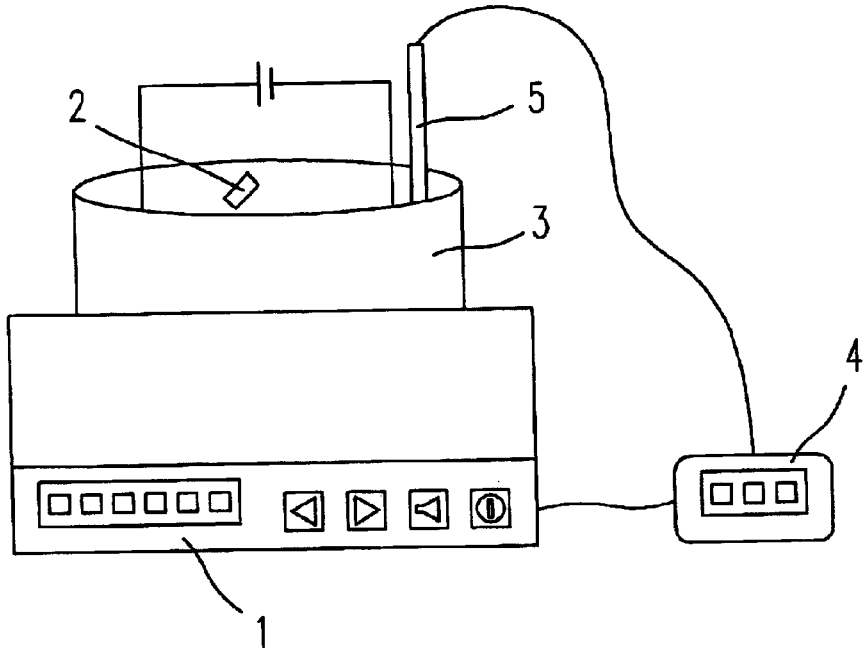
FIG. 1 is a schematic diagram showing an anodic oxidization device for forming a field emission electrode according to the present invention.
Figure 2:
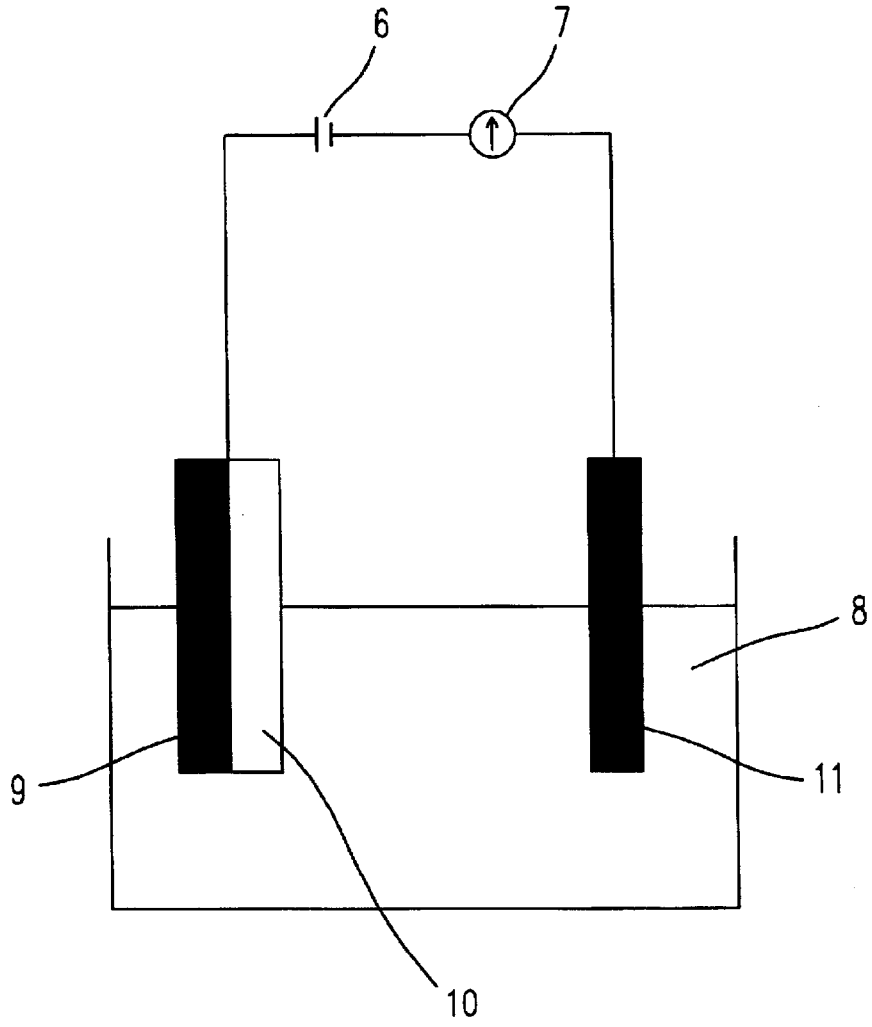
FIG. 2 is a schematic diagram showing a hot bath tank of an anodic oxidization device shown in FIG. 1 for forming a field emission electrode according to the present invention.
Figure 3A:
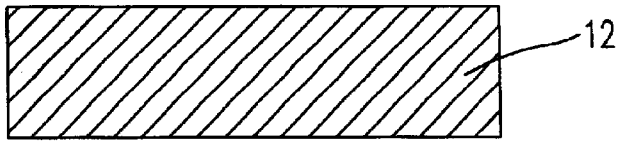
FIGS. 3(*a*)~(*g*) are the schematic diagrams showing a process of forming a field emission electrode according to a first preferred embodiment of the present invention.
Figure 3B:
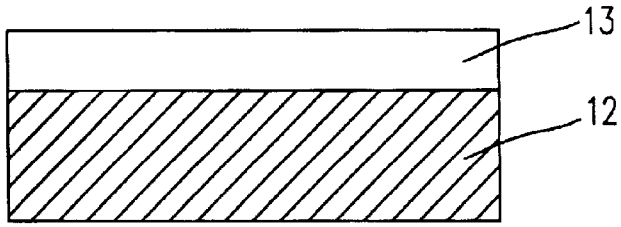
Figure 3C:
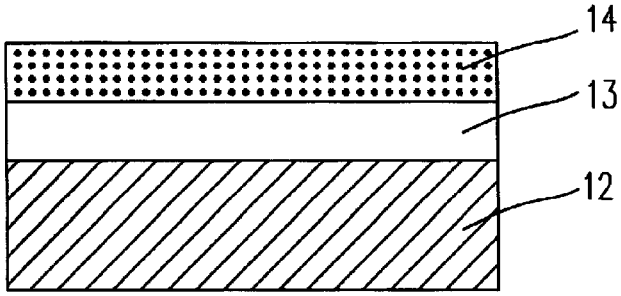
Figure 3D:
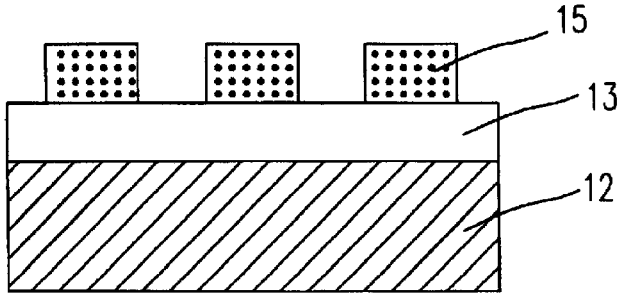
Figure 3E:
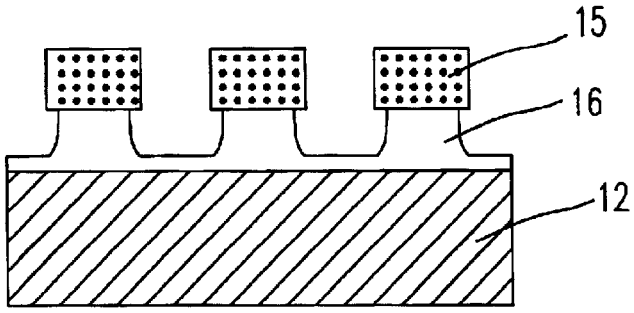
Figure 3F:
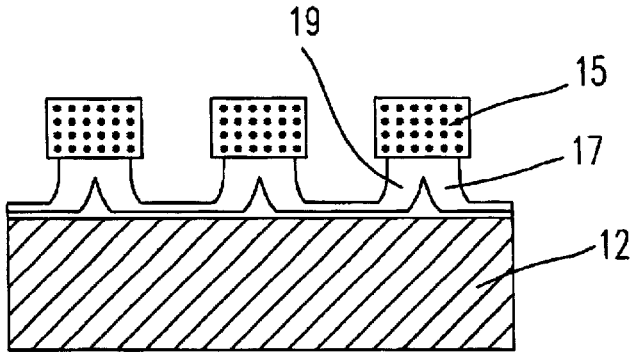
Figure 3G:
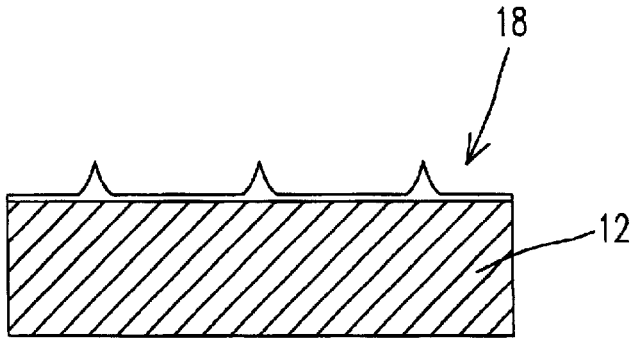
Figure 4A:
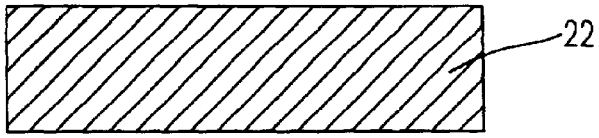
FIGS. 4(*a*)~(*h*) are the schematic diagrams showing a process of forming a field emission electrode according to a second preferred embodiment of the present invention.
Figure 4B:
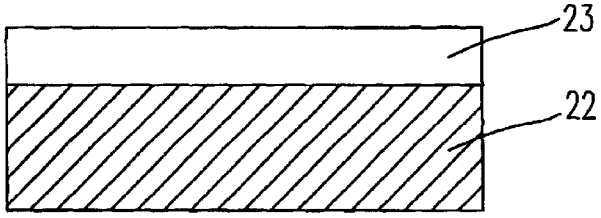
Figure 4C:
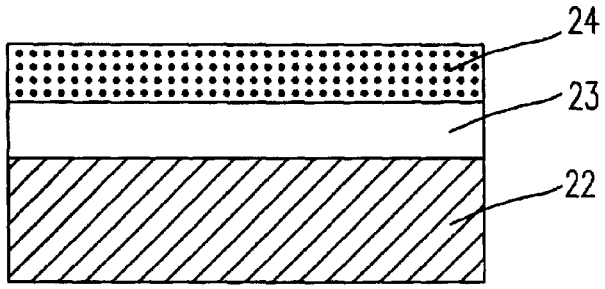
Figure 4D:
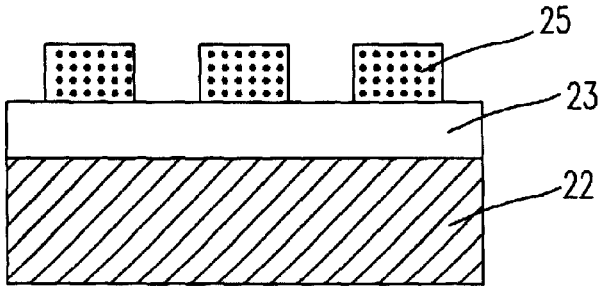
Figure 4E:
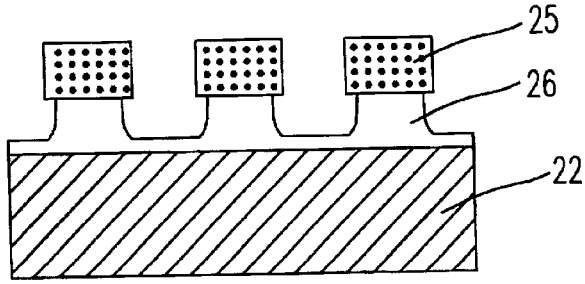
Figure 4F:
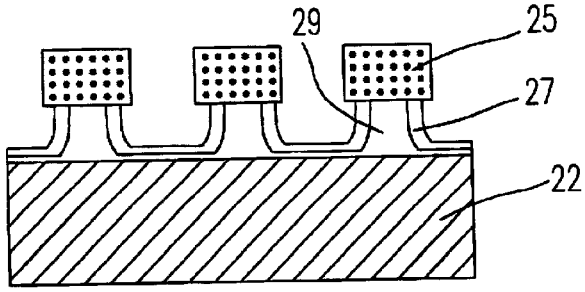
Figure 4G:
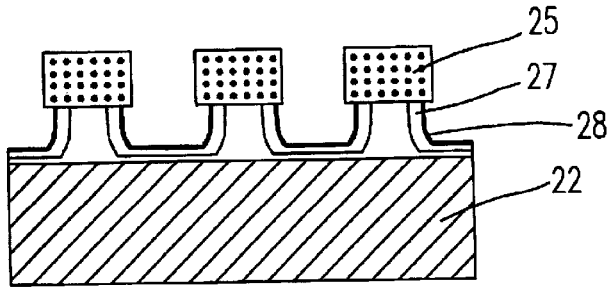
Figure 4H:
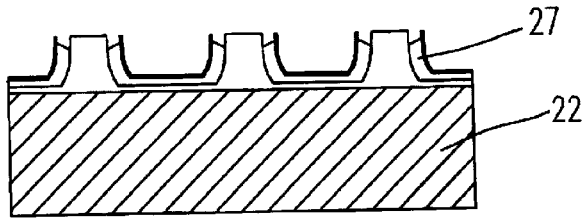

According to the present invention, a field emission electrode is formed by an anodic oxidization method. Please refer to FIG. 1 which is a schematic diagram showing an anodic oxidization device for forming a field emission electrode according to the present invention. The device includes a heater 1, a rotator 2, a hot bath tank 3, a temperature controller 4 and a temperature sensor 5. FIG. 2 schematically shows a hot bath tank 3 of an anodic oxidization device shown in FIG. 1 for forming a field emission electrode according to the present invention. The hot bath tank 3 includes a multi-meter 7, an electrolytic solution 8, a substrate 9, an anode 10 (or a remained metal layer) and a cathode 11. According to the present invention, a surface of a remained metal layer shown in FIG. 3(*f*) or FIG. 4(*f*) is oxidized for forming a field emission electrode, wherein the remained metal layer is serving as an anode 10 in FIG. 2.

Please refer to FIGS. 3(*a*)~(*g*) which are the schematic diagrams showing a process of forming a field emission electrode according to a first preferred embodiment of the present invention. A substrate 12 having a metal layer 13 thereon is provided first. The metal layer 13 is then formed on the substrate 12 by electron gun evaporation, sputtering technique or heat coating technique. Preferably, the substrate 12 is made of plastic, quartz or glass. Preferably, the metal layer 13 is an aluminum layer, a tungsten layer, a tantalum layer, a molybdenum layer, a molybdenum-tungsten alloy layer or a molybdenum-tantalum layer. As shown in FIG. 3(*c*) and FIG. 3(*d*), after a photoresist layer 14 is formed on the metal layer 13, a portion of the photoresist layer 14 is removed by a photolithography technique to form plural mask units, i.e. remained photoresist 15. As shown in FIG. 3(*e*), the metal layer 13 uncovered by the remained photoresist layer 15 is then partially removed by an etching method to form the remained metal layer 16. Preferably, the etching method is a reactive ion etching method or a wet etching method. Thereafter, referring to FIG. 3(*f*), a surface of the remained metal layer 16 is oxidized by an anodic oxidization method for forming a metal oxide layer 17 thereon such that an upper portion 19 of the unoxidized remained metal layer is in the shape of plural conoids. Finally, the remained photoresist layer 15 and the metal oxide layer 17 is removed to form the field emission array 18 as shown in FIG. 3(*g*).

Please refer to FIGS. 4(*a*)~(*h*) which are the schematic diagrams showing a process of forming a field emission electrode according to a second preferred embodiment of the present invention. A substrate 22 having a first metal layer 23 thereon is provided first. The first metal layer 23 is then formed on the substrate 22 by electron gun evaporation, sputtering technique or heat coating technique. Preferably, the substrate 22 is made of plastic, quartz or glass. Preferably, the first metal layer 23 is an aluminum layer, a tungsten layer, a tantalum layer, a molybdenum layer, a molybdenum-tungsten alloy layer or a molybdenum-tantalum layer. As shown in FIG. 4(*c*) and FIG. 4(*d*), after a photoresist layer 24 is formed on the first metal layer 23, a portion of the photoresist layer 24 is removed by a photolithography technique to form plural mask units, i.e. remained photoresist layer 25. As shown in FIG. 4(*e*), the first metal layer 23 uncovered by the remained photoresist layer 25 is then partially removed by an etching method to form the remained metal layer 26. Preferably, the etching method is a reactive ion etching method or a wet etching method. Thereafter, referring to FIG. 4(*f*), a surface of the remained first metal layer 26 is oxidized by an anodic oxidization method for forming a metal oxide layer 27 thereon such that an upper portion 29 of the unoxidized remained first metal layer 26 is in the shape of plural chimneys. Then, as shown in FIG. 4(*g*), a second metal layer 28 serving as a gate is formed on the metal oxide layer 27. The second metal layer 28 is formed on the metal oxide layer 27 by electron gun evaporation, sputtering technique or heat coating technique. Preferably, the second metal layer 28 is an aluminum layer, a tungsten layer, a tantalum layer, a molybdenum layer, a molybdenum-tungsten alloy layer or a molybdenum-tantalum layer. Finally, the remained photoresist layer 25 is removed to form the field emission array as shown in FIG. 4(*h*).

As described above, the present invention is directed to a process of forming a field emission electrode for manufacturing a field emission array. The field emission electrode is formed by an anodic oxidization method. By optimizing the oxidization parameters, e.g. the oxidization voltage, the oxidization time, the rotation speed of the rotator and the content of the electrolytic solution, a field emission electrode with large area and good thickness uniformity can be formed at room temperature by controlling the oxidization speed and the density of the metal oxide layer. As an aluminum layer as an illustration, Table 1 shows the oxidized aluminum of different types by using different types of electrolytic solution. The problems encountered in the prior arts are solved, therefore the present invention possesses inventive step, and it's unobvious for one skilled in the art to develop the present invention.

TABLE 1

| Sample Label | Oxidization Voltage (V) | Oxidization Time | oxide Electrolytic Solution | Thickness of metal layer |
|---|---|---|---|---|
| B1 | 40 | 600 | [ammonium tartarte 3% (wt)]:[ethyl glycol] = 1:9(vol)~4:6(vol) | 55 |
| B2 | 100 | 600 | | 132.3 |
| B3 | 150 | 600 | | 195.4 |
| P1 | 30 | 90 | oxalic acid 5% (wt) | 132.8 |
| P2 | 30 | 180 | | 262.6 |
| P3 | 30 | 240 | | 341.6 |
| C1 | 30 | 90 | oxalic acid 5% (wt) | 160.8 |
| | 40 | 600 | [ammonium tartarte 3% (wt)]:[ethyl glycol] = 1:9(vol)~4:6(vol) | |
| C2 | 160 | 160 | oxalic acid 5% (wt) | 276.6 |
| | 600 | 600 | [ammonium tartarte 3% (wt)]:[ethyl glycol] = 1:9(vol)~4:6(vol) | |
| C3 | 220 | 220 | oxalic acid 5% (wt) | 364.1 |
| | 600 | 600 | [ammonium tartarte 3% (wt)]:[ethyl glycol] = 1:9(vol)~4:6(vol) | |

※Sample B represents barrier-type aluminum.
Sample P represents porous-type aluminum.
Sample C represents composite-type aluminum.

While the invention has been described in terms of what are presently considered to be the most practical and preferred embodiments, it is understood that the invention need not be limited to the disclosed embodiment. On the contrary, it is intended to cover various modifications similar arrangements included within the spirit and scope of the appended claims which are to be accorded with the broadest interpretation so as to encompass all such modifications and similar structures. Therefore, the above description and illustration should not be taken as limiting the scope of the present invention which is defined by the appended claims.

What is claimed is:

1. A process of forming a field emission electrode for manufacturing a field emission array, comprising steps of:

(a) providing a substrate having a metal layer thereon;

(b) forming a plurality of mask units on said metal layer and partially removing said metal layer uncovered by said mask units;

(c) oxidizing a surface of the remained metal layer by an anodic oxidization method for forming a metal oxide layer thereon such that an upper portion of the unoxidized remained metal layer is in the shape of plural conoids; and (d) removing said remained mask units and said metal oxide layer.

2. The process according to claim 1, wherein said substrate is made of a material selected from a group consisting of plastic, quartz and glass.

3. The process according to claim 1, wherein said metal layer is selected from a group consisting of aluminum layer, tungsten layer, tantalum layer, molybdenum layer, molybdenum-tungsten alloy layer and molybdenum-tantalum alloy layer.

4. The process according to claim 3, wherein said metal layer is formed on said substrate by a method selected from a group consisting of electron gun evaporation, sputtering technique and heat coating technique.

5. The process according to claim 1, wherein said step (b) is performed by a photolithography technique and an etching method.

6. The process according to claim 5, wherein said etching method is selected from reactive ion etching method and wet etching method.

7. A process of forming a field emission electrode for manufacturing a field emission array, comprising steps of:

(a) providing a substrate having a metal layer thereon;

(b) forming a photoresist layer on said metal layer and removing a portion of said photoresist layer by a photolithography technique;

(c) partially removing said metal layer uncovered by the remained photoresist layer;

(d) oxidizing a surface of the remained metal layer by an anodic oxidization method for forming a metal oxide layer thereon such that an upper portion of the unoxidized remained metal layer is in the shape of plural conoids; and (e) removing said remained photoresist layer and said metal oxide layer.

8. The process according to claim 7, wherein said metal layer is selected from a group consisting of aluminum layer, tungsten layer, tantalum layer, molybdenum layer, molybdenum-tungsten alloy layer and molybdenum-tantalum alloy layer.

9. A process of forming a field emission electrode for manufacturing a field emission array, comprising steps of:

(a) providing a substrate having a first metal layer thereon;

(b) forming a plurality of mask units on said first metal layer and partially removing said first metal layer uncovered by said mask units;

(c) oxidizing a surface of the remained first metal layer by an anodic oxidization method for forming a metal oxide layer thereon such that an upper portion of the unoxidized remained first metal layer is in the shape of plural cylinders;

(d) forming a second metal layer on said metal oxide layer; and (e) removing said remained mask units.

10. The process according to claim 9, wherein said substrate is made of a material selected from a group consisting of plastic, quartz and glass.

11. The process according to claim 9, wherein said first metal layer and said second metal layer are selected from a group consisting of aluminum layer, tungsten layer, tantalum layer, molybdenum layer, molybdenum-tungsten alloy layer and molybdenum-tantalum alloy layer.

12. The process according to claim 11, wherein said first metal layer is formed on said substrate by a method selected from a group consisting of electron gun evaporation, sputtering technique and heat coating technique.

13. The process according to claim 11, wherein said second metal layer is formed on said metal oxide layer by a method selected from a group consisting of electron gun evaporation, sputtering technique and heat coating technique.

14. The process according to claim 9, wherein said step (b) is performed by a photolithography technique and an etching method.

15. The process according to claim 14, wherein said etching method is selected from reactive ion etching method and wet etching method.

16. A process of forming a field emission electrode for manufacturing a field emission array, comprising steps of:

(a) providing a substrate having a first metal layer thereon;

(b) forming a photoresist layer on said first metal layer and removing a portion of said photoresist layer by a photolithography technique;

(c) partially removing said first metal layer uncovered by the remained photoresist layer;

(d) oxidizing a surface of the remained first metal layer by an anodic oxidization method for forming a metal oxide layer thereon such that an upper portion of the unoxidized remained first metal layer is in the shape of plural chimneys;

(e) forming a second metal layer on said metal oxide layer; and (f) removing said remained photoresist layer.

17. The process according to claim 16, wherein said first metal layer and said second metal layer are selected from a group consisting of aluminum layer, tungsten layer, tantalum layer, molybdenum layer, molybdenum-tungsten alloy layer and molybdenum-tantalum alloy layer.

* * * * *